United States Patent [19]

Larsen et al.

[11] 4,109,341

[45] Aug. 29, 1978

[54] UNIDIRECTIONAL FLOW PICKUP HOOD FOR STREET SWEEPERS

[75] Inventors: Gregory J. Larsen, Claremont; Jan A. Hiszpanski, Upland, both of Calif.

[73] Assignee: FMC Corporation, San Jose, Calif.

[21] Appl. No.: 821,670

[22] Filed: Aug. 4, 1977

Related U.S. Application Data

[63] Continuation of Ser. No. 647,305, Feb. 5, 1976, abandoned.

[51] Int. Cl.[2] ..... E01H 1/08

[52] U.S. Cl. ..... 15/340; 15/346

[58] Field of Search ..... 15/340, 345, 346

[56] References Cited

U.S. PATENT DOCUMENTS

| | | | |
|---|---|---|---|
| 514,676 | 2/1894 | Furnas | 15/340 X |
| 514,677 | 2/1894 | Furnas | 15/340 X |
| 514,678 | 2/1894 | Furnas | 15/340 X |
| 1,211,902 | 1/1917 | Warner | 15/346 |
| 2,758,041 | 8/1956 | Denning | 15/345 X |
| 3,512,206 | 5/1970 | Young | 15/346 |
| 3,662,427 | 5/1972 | Hanna | 15/346 |
| 3,755,851 | 9/1973 | Williams | 15/346 |

FOREIGN PATENT DOCUMENTS

| | | | |
|---|---|---|---|
| 1,155,156 | 10/1963 | Fed. Rep. of Germany | 15/346 |

*Primary Examiner*—Christopher K. Moore

*Attorney, Agent, or Firm*—J. F. Verhoeven; C. E. Tripp

[57] ABSTRACT

The hood for an air recirculation type of street sweeper forms a single, unidirectional air flow duct from the air inlet line to the air return. The top wall of the hood is formed to provide an air stream deflector that slants downwardly in the direction of the air return line and accelerates the air stream to insure that all debris is entrained in the air stream as it leaves the hood.

12 Claims, 6 Drawing Figures

UNIDIRECTIONAL FLOW PICKUP HOOD FOR STREET SWEEPERS

This application is a continuation of Ser. No. 647,305, filed Feb. 5, 1976, and now abandoned.

FIELD OF THE INVENTION

This invention relates to street sweepers and more particularly to a debris pickup hood through which air circulates to entrain the debris in an air stream that enters a hopper.

DESCRIPTION OF THE PRIOR ART

The patent to Hanna U.S. Pat. No. 3,662,427, issued May 16, 1972, discloses a pickup hood for a sweeper that extends transversely of the motion of the vehicle. The sweeper employs a main blower which exhausts air from the hopper and delivers air at one end of the hood to a pressure chamber that extends along the hood. An air return line from the other end of the hood is connected to the hopper and delivers debris picked up under the hood to the hopper. The hopper is divided into three chambers, a front vacuum chamber and a rear vacuum chamber, the latter being considerably wider than the front chamber. Both vacuum chambers are in communication with the air return line leading to the hopper. A pressure chamber is formed within the hood by spaced vertical walls that extend from the air inlet line to the air return line. One of the walls of the pressure chamber stops short of the swept surface by a distance of one half inch so that air not only flows from one end of the pressure chamber to the other (transverse to vehicle motion) but also flows transverse to the hood from the pressure chamber to the rear vacuum chamber (contrary to the direction of vehicle motion) under a wall that is common to the pressure chamber and the rear vacuum chamber, which wall is spaced one-half inch from the swept surface. The air that flows out from under the aforesaid wall of the pressure chamber eventually reaches the air return line and is directed by a spoiler plate into the air return line, there being a tendency for vortex formation at the location of the spoiler plate.

The United States Young Pat. No. 3,512,206, issued May 19, 1970 shows an air flow surface cleaning apparatus which has a pickup hood that extends transversely of the direction of motion of the vehicle, associated with a blower that delivers air to one end of the pickup hood. The air enters a pressure chamber which has an upper wall and a lower wall spaced from the swept surface. Air leaves the pressure chamber through a nozzle which is inclined to the swept surface and the air moves transversely of the pickup hood which is in the direction of motion of the hood along the surface. Air leaving the pressure chamber enters a suction chamber which has an upper wall, which is inclined from the swept surface and the inclination is such that the spacing of the upper wall of the suction chamber from the surface increases in the direction of the flow of air through the chamber. Thus in the Young patent the air changes direction within the hood. The suction chamber delivers air to a return line connected to the hopper. A curved flow direction changing vane is provided near the end of the pickup hood at the entrance to the return line from the vacuum chamber. The patent specification of the Young patent specifically states that a compound flow of air both transversely and longitudinally of the hood is more effective than the flow of air in one direction only. (Col. 6, lines 29 - 44).

The United States Block Pat. No. 3,872,540, issued Mar. 25, 1975 discloses a pickup hood that is similar to the hood of the Young patent just described above. The hood of the Block patent likewise extends transversely or laterally of the vehicle and includes an air distribution chamber having an upper wall spaced from the swept surface and a slot like nozzle or aperture extending longitudinally of the hood. Air from the blower is introduced to the distribution chamber and this air flows through the slot transversely of the hood and in the direction of motion of the hood along the surface into a primary exhaust chamber, and must change direction 90° to reach the air return line. The primary exhaust chamber is in communication with an air return line leading to the hopper with the blower withdrawing air from the hopper. The Block patent shows a third chamber in the form of a secondary exhaust chamber that is behind the air distribution chamber and has a secondary exhaust line that connects to the main air exhaust or return line leadint to the hopper from the primary exhaust chamber.

Italian Pat. No. 588,799 discloses a snow removal unit wherein air from a blower is delivered to a louvred nozzle that extends transversely of the vehicle and directs air in the direction of vehicle motion at an angle to the surface being swept. The hood includes a deflector spaced from the swept surface and an air intake mouth that receives air flowing laterally of the hood and contrary to the direction of motion of the vehicle. The air intake mouth is inclined in the manner of the nozzle and delivers return air and snow to a collector. The collector, which may be a cyclone, is connected to the inlet of the main blower in one modification and excess air is delivered to the atmosphere by a branch of the recirculation line connected to the inlet of the blower.

SUMMARY OF THE INVENTION

Prior pickup or air sweeping hoods of the air recirculating type have been divided into at least two chambers which are commonly referred to as pressure or air distribution chambers and as vacuum or air exhaust chambers. The construction of these prior devices is such that the air flowing from the inlet to the outlet line of the hood is given a motion in two directions, namely, a motion longitudinally of the hood and a motion transversely of the hood, it being understood that since the hoods themselves are usually disposed transversely of the vehicle path, air flowing longitudinally of the hood actually flows transversely, relative to the path of the hood along the swept surface.

This change in direction of the sweeping air within the hood results in pressure losses and vortex formation which may reduce the efficiency of the debris pickup action of the air stream. Commercial embodiments of hoods employing bi-directional air flow are disclosed in the Hanna and Young patents previously referred to. In accordance with the present invention, the pickup hood comprises a duct like body that extends generally transversely of the vehicle and has an air inlet at one end and an air exhaust or return line at the other end. The air flow duct provides for unidirectional air flow from its inlet to its outlet end and the hood is not divided into pressure or distribution chambers and into separate vacuum or exhaust chambers.

Thus, the present invention provides a single, unidirectional stream of air which is not directed transversely of the hood as the air stream flows in and out of the hood and along the swept surface. The single air duct principle of the hood of the present invention makes it possible to maximize the utilization of the total energy of the flowing air delivered to the hood from a blower. As the stream of air in the hood duct sweeps across debris, the particles of debris are gradually accelerated from zero velocity to a velocity such that they are entrained in the air stream and leave the hood along with the air stream through the air return line and on to the hopper. This transfer of energy from the air stream to the debris slows down the air stream somewhat and creates a pressure drop along the path of the air stream. By utilizing an unobstructed, simple duct-like structure which does not change the direction of the air stream and entrained debris until they leave the hood, the retarding effect of the entrained debris on the air stream flow is minimized, although if the duct has the same cross sectional area along its entire length the air stream will slow down as the mass of the entrained debris increases toward the exit.

In the preferred embodiment of the invention, drop-out of debris adjacent the exit of the air stream from the pickup hood is prevented by gradually accelerating the air stream from a zone upstream of the exit or air return line along the hood to the return line, without changing the direction of the stream. The air stream acceleration is roughly proportional to the increase of flow rate of the debris particles entrained in the air stream. This provides acceleration of the air stream in a simple manner. A simple plate or deflector is provided so that it forms the upper wall or "roof" of the duct forming the pickup hood. The spacing of the deflector from the swept surface gradually decreases from a maximum spacing at a zone upstream of the air return line to a minimum spacing at the air return line. Thus, the deflector gradually increases the air stream velocity as it flows along the hood which compensates for the loss in air stream velocity that would otherwise occur due to the transfer of momentum from the air stream to the particles of debris.

The deflector forms the upper wall or "roof" of the air stream duct and the sidewalls of the duct are preferably substantially parallel. Thus the deflector provides a full width, "flattened" stream of air that impinges on the swept surface, increases in velocity and provides an effective scrubbing action. The aforesaid increase of the air stream velocity along the longitudinal extent of the hood (the hood being transverse to the direction of motion of the vehicle) maintains debris particles in entrainment with the air stream and they are not deposited out as the air stream approaches the air return line.

In order to avoid the separation of particles from the air stream as the air stream changes direction and leaves through the air return line, a curved baffle is provided at the outlet port for the return line so that debris particles are swept up out of the hood along with the air stream leaving the hood. Thus, a single air duct pickup hood is provided which does not change the direction of the air stream over the sweeping zone and which maintains an effective sweeping action by the air stream between the points where the air stream enters the hood at one end and leaves it at the other end. Pressure losses along the hood are minimized, the hood construction is simple and economical and its sweeping action is superior to more complex hoods now available to the trade.

The manner in which these advantages can be obtained can be apparent from the following detailed description of the preferred embodiment of the invention.

IN THE DRAWINGS

DESCRIPTION OF PREFERRED EMBODIMENT

SWEEPER INSTALLATION

Figure 1:
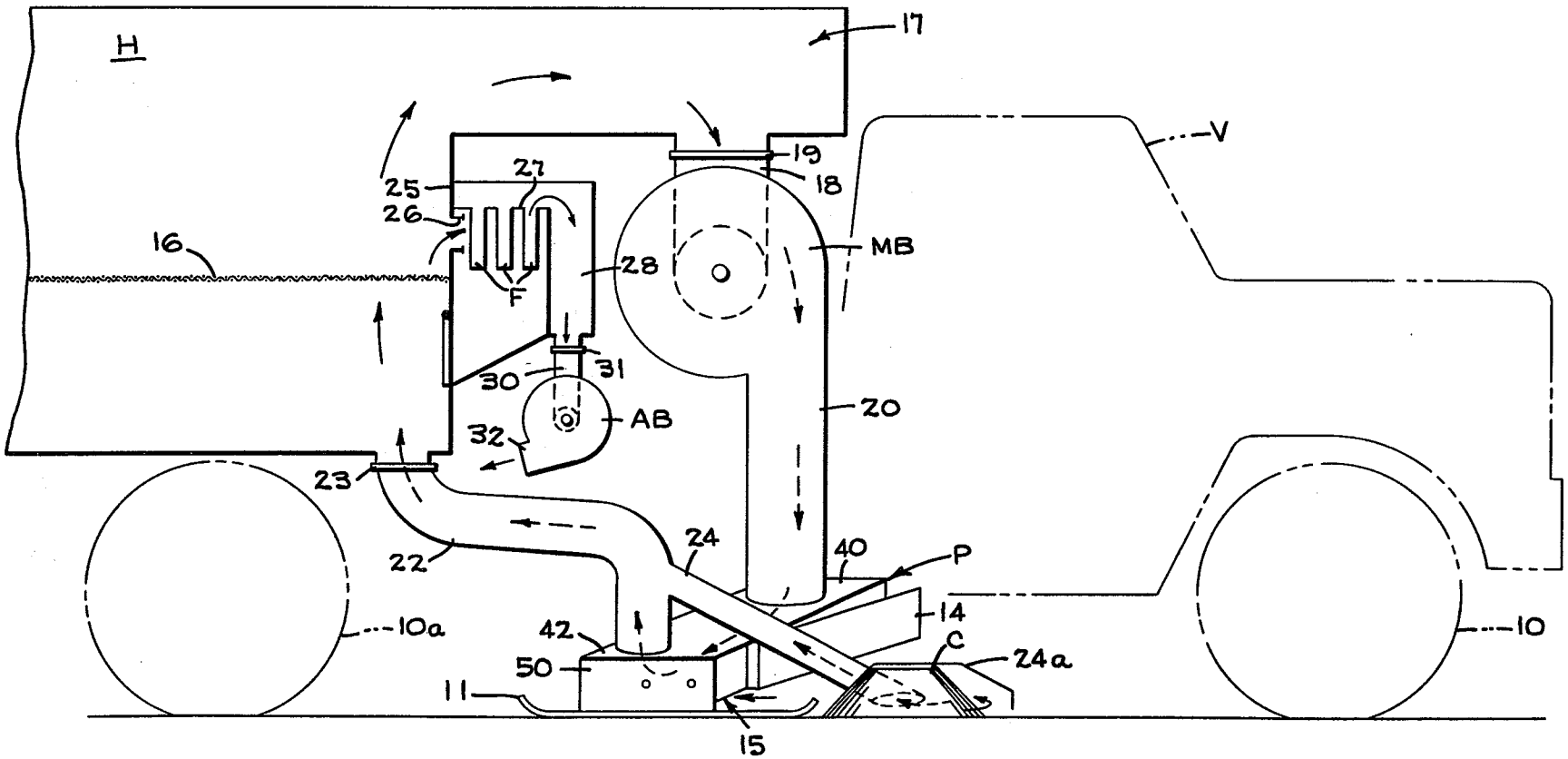
FIG. 1 is a highly diagrammatic schematic view of a street sweeper air flow system embodying the hood construction of the present invention.

Before describing the improved pickup hood of the present invention, the mode of operation of a sweeper system embodying the invention will be summarized in connection with the diagram of FIG. 1, which is a highly schematic diagram indicating the flow pattern in the air system of a sweeper embodying the hood of the present invention. It is to be understood that the pickup hood of the present invention can be employed on sweeper systems other than that to be described as an example.

The sweeping system is mounted on a mobile vehicle V, which may be a converted truck chassis, the chassis being signified by the front and rear wheels 10,10*a*. The sweeping system includes a main debris pickup unit in the form of a pickup hood P embodying the present invention, which is mounted on the chassis and provides a transversely mounted duct-like housing, to be described in detail presently. The hood has surface engaging skids 11 and 11*a* (FIGS. 3 and 6) at each end and has surface engaging flaps, which will be described presently. The air flow system shown in FIG. 1 forms the subject matter of the copending application of Larsen, Ser. No. 647,485, filed Jan. 8, 1976, now U.S. Pat. No. 4,006,511, issued Feb. 8, 1977; entitled *Sweeper with Recirculation Hood and Independent Filter System*, assigned to the FMC Corporation.

The sweeping hood P is mounted on the vehicle chassis by a trailing link suspension in a manner known in the art and described in the aforesaid copending application of Larsen. Associated with the hood P is a deflector 14 which windrows large articles, such as cans or the like, laterally to an air lock system indicated generally at 15, wherein the articles are admitted to the hood P through alternately opening pivoted doors 15*a* and 15*b* (FIG. 4) without substantially opening the hood to the atmosphere. Incorporation of the deflector 14 and the airlock system 15 is not essential to the hood duct construction of the present invention.

The airlock system 15 forms the subject matter of the copending application of Larsen, Ser. No. 647,521, filed Jan. 8, 1976, entitled *Pickup Hood With Air Lock*, also assigned to the FMC Corporation.

Mounted on the vehicle chassis is a debris hopper H. This hopper is a box-like structure that can be elevated about a rear pivot on the vehicle frame (not shown) to discharge accumulated debris through a rear hopper door, as described in detail in the first mentioned aforesaid copending Larsen application, Ser. No. 647,485.

The hopper H is fitted with a screen 16 to filter out coarse debris and one side of the hopper is formed with a forwardly projecting air exhaust chamber 17 which, during the sweeping operation, connects with the inlet 18 of a main blower MB, by means of a sealing gasket 19 that permits lifting of the hopper. The main blower withdraws air from the hopper and delivers it to one end of the pickup hood P by an air delivery or inlet line or duct 20. An air return or outlet line 22 is connected between the other end of the hood duct and the bottom of the hopper H through a sealing gasket 23 that permits tilting of the hopper. The air return line 22 draws a debris laden air stream into the hopper. In the embodiment shown, a suction line 24 is connected to the air return line 22, and the line 24 exhausts air and dust from within a shroud 24a that partially surrounds a curb brush C.

A front wall or partition 25 of the hopper H is formed with an opening 26 which communicates with a compartment containing a filter assembly for filtering out fine particles. The filter system comprises a series of tubular, porous filter elements F depending from a partition 27. Preferably, the filter elements are constructed in accordance with the principles of the copending application of Groh Ser. No. 602,275, filed Aug. 13, 1975, now U.S. Pat. No. 4,007,026, issued Feb. 8, 1977 and entitled *Compact Dust Filter System* and assigned to the FMC Corporation. However, the details of the filter system are not critical to the present invention. Air is drawn through the porous walls of the filter elements depositing dust on their exterior surfaces. Filtered air is drawn out through the open upper ends of the filter into a filtered air chamber 28, which is connected to the inlet 30 of an auxiliary blower AB, through a separable sealing gasket 31. The exhaust 32 of the auxiliary blower delivers filtered air to the atmosphere.

HOOD CONSTRUCTION

Referring to FIGS. 2 – 6, the pickup hood P of the present invention embodies an elongate rectangular duct indicated generally at 40. The duct has a top wall 42, a front wall 44 (the motion of the hood along the surface being indicated by a large arrow on several of the figures) and a rear wall 46.

The ends of the duct are closed by an end wall 48 adjacent the air inlet line 20 and an end wall 50 adjacent the air return line 22. The end walls 48 and 50 mount the skids 11a, 11 which engage the swept surface and form seals for the ends of the duct.

Figure 2:
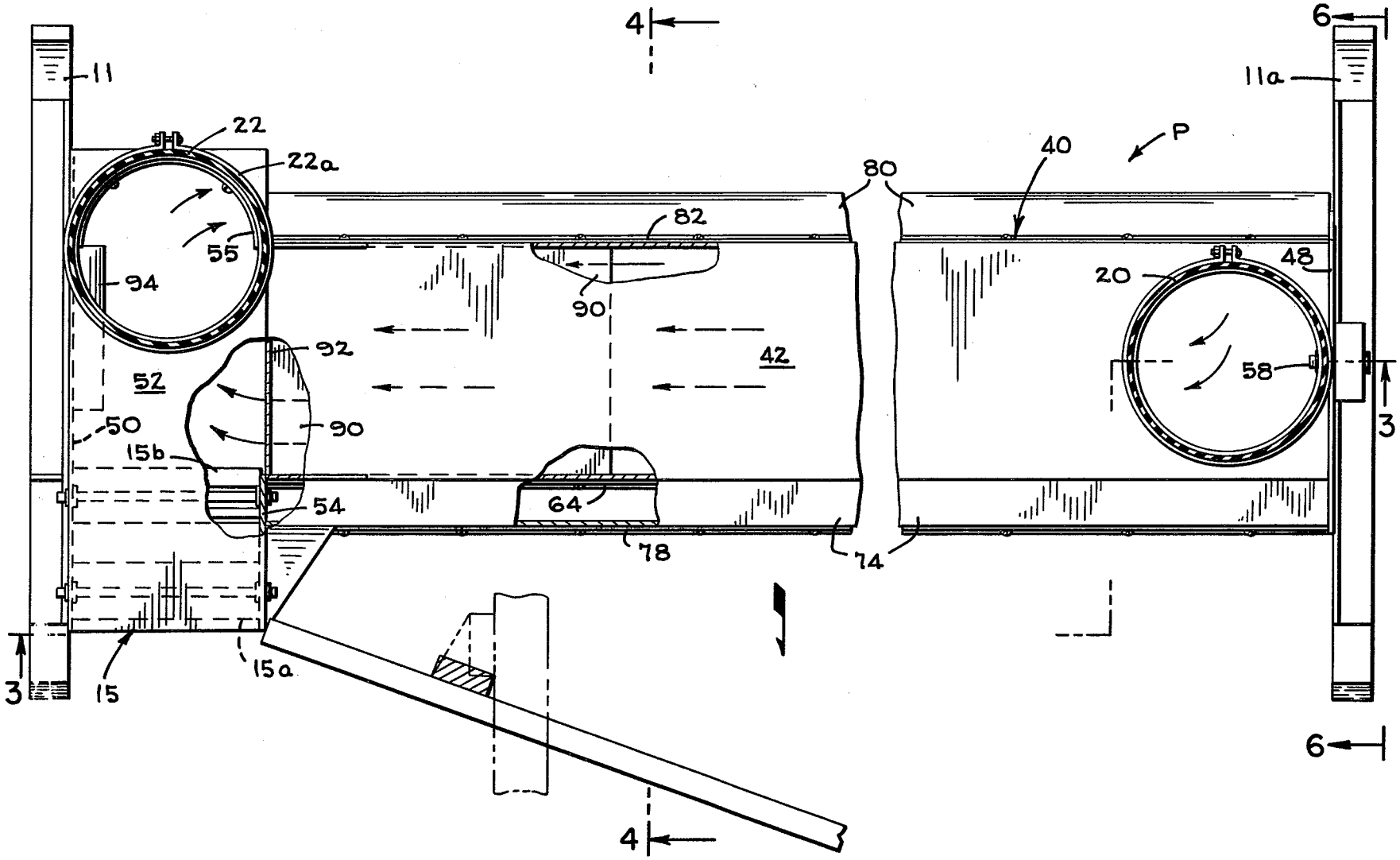
FIG. 2 is a plan view of the hood with parts broken away.
Figure 3:
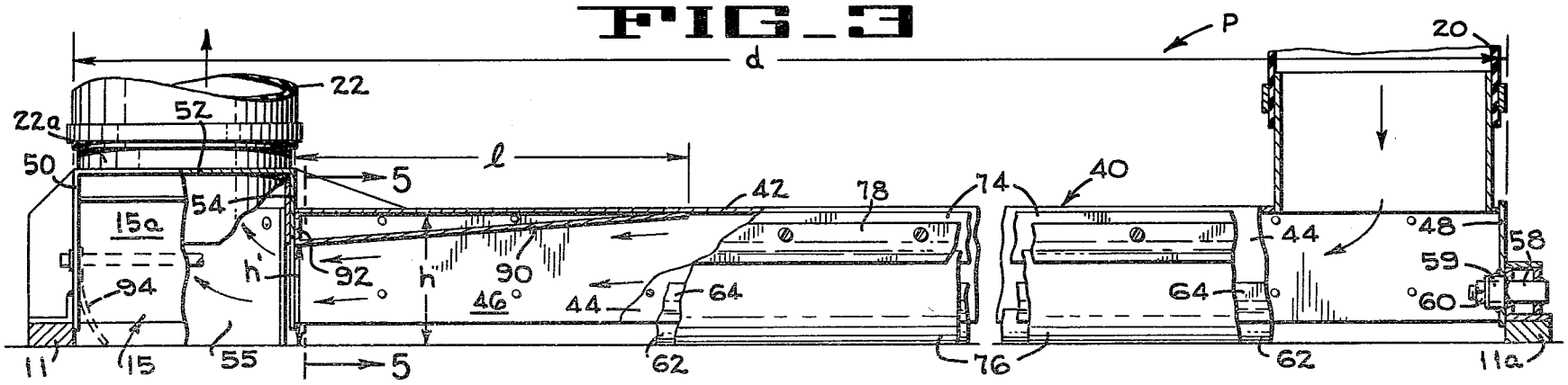
FIG. 3 is a section of the hood looking on line 3 — 3 of FIG. 2 with parts broken away.
Figure 5:
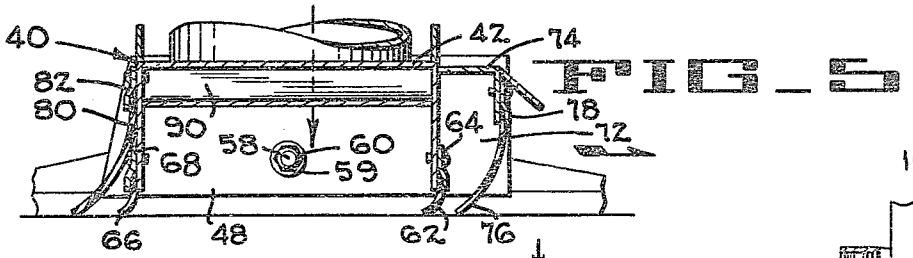
FIG. 5 is a vertical section through the hood taken on line 5 — 5 of FIG. 3.

The end wall 50 actually forms part of the box-like structure or tunnel that mounts the air lock system 15, previously mentioned. This tunnel structure communicates with the duct 40 and has a top wall 52, an inside wall 54 which joins the end of the duct 40 as seen in FIGS. 2 and 3. The front of the airlock tunnel is open but the tunnel is closed by sequentially opening doors or flaps 15*a*, 15*b*, as described in the aforesaid copending application of Larsen, Ser. No. 647,521 entitled *Sweeper Hood With Air Lock.*

Figure 4:
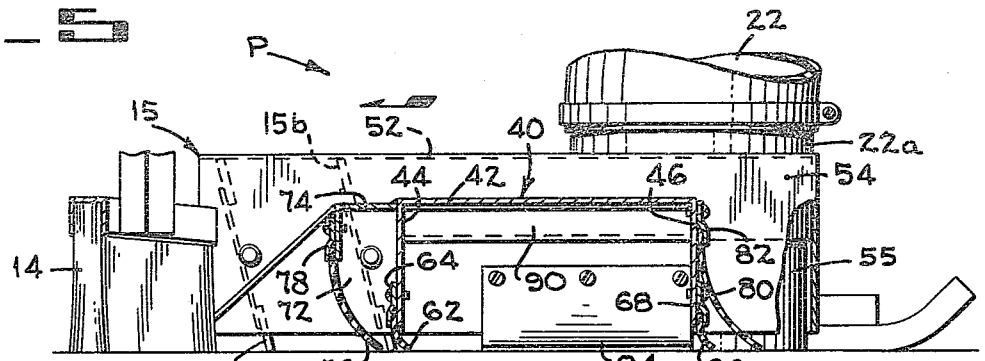
FIG. 4 is a vertical section through the hood taken on line 4 — 4 of FIG. 2.

As seen in FIGS. 2, 3 and 4, the air return line 22 includes a short metal duct 22*a* that is welded to the top wall 52 of the air lock tunnel. A semi-circular baffle 55 is attached to the duct 22*a* and extends down close to the swept surface.

Figure 6:
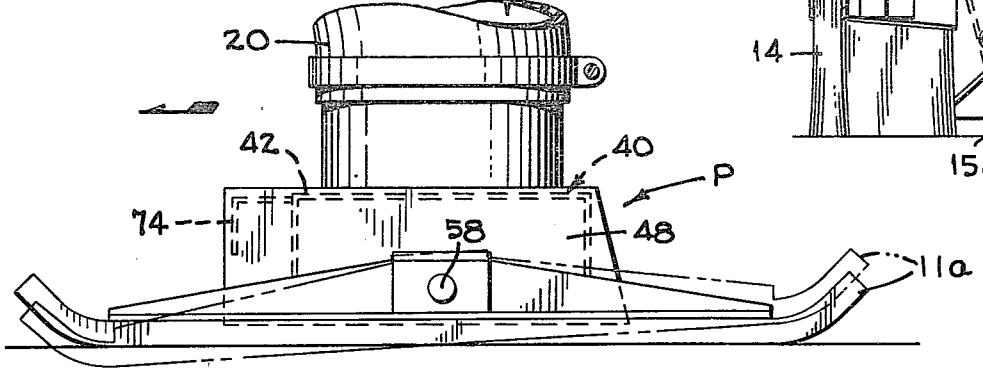
FIG. 6 is an end view of the hood looking on as indicated by line 6 — 6 of FIG. 2.

As seen in FIGS. 3 and 6, the skid 11*a* is pivotally mounted on the end wall 48 of the duct. The skid is welded to a stub shaft 58 which pivots in a collar 59 welded to the end wall 48 and is retained by a lock nut 60 that is adjusted to allow pivotal motion of the skid as indicated in broken lines in FIG. 6. This construction facilitates maintaining engagement of the flaps, to be described presently, with the swept surface when the hood is dragged over irregular surfaces. The pivoted skid construction is included as the subject matter of the aforesaid Larsen application, Ser. No. 647,521.

The front wall 44 of the duct 40 has relatively short ground engaging flaps 62, (FIGS. 4 and 5) retained by a clamp strip 64 screwed to the wall 44. These flaps are preferably formed of an elastic element and are about three-sixteenth inches thick. Similar flaps 66 are secured to the rear wall 46 of the duct 40 by a clamp strip 68. It is noted that the flaps 62,66 that seal the front of the rear walls of the duct 40 are relatively short. As described in the aforesaid copending application of Larsen, Ser. No. 647,521, these flaps can be made shorter than usual in systems of this type because the deflector and air lock system of the aforesaid application admits large articles of debris, which articles need not pass under the front wall 44 and its flap 62 in order to be picked up and delivered to the air return line.

In order to provide an air lock effect for small particles of debris that pass under the deflector brush 14, a dead air chamber 72 is provided at the front of the duct 40. This dead air chamber is formed by an angle iron 74 welded to the upper portion of the front side wall 44 of the duct 40 (FIGS. 4 and 6). The angle 74 mounts a relatively long flexible flap 76 clamped to the angle by a clamp strip 78. Air is not circulated through the chamber 72 but the relatively flexible flap 76 forming the front wall of that chamber operates in conjunction with the flap 62 of the duct 40 to admit small particles of debris to the duct without puffing of dust to the atmosphere from within the duct. A flexible flap 80, which is clamped to the rear side wall 46 of the duct 40 by a clamp strip 82, augments the seal provided by the main flap 66 for the duct.

As previously mentioned, as air flows through the duct 40 from the air inlet line 20 to the air return line 22, an air stream is established which, in addition to encountering the relatively small frictional losses caused by the walls of the duct 40 also encounters retarding effects engendered by the pickup and acceleration of debris particles. The debris particles must be accelerated from zero velocity to a velocity approaching that of the air stream and this pickup and acceleration action is provided by transfer of energy from the air stream to the particles, overcoming the inertia of the particles and accelerating them to a velocity in the direction of air flow through the duct.

This transfer of energy from the air stream to the particles of debris inherently reduces the velocity of the air stream and in some cases particles of debris may be dropped out as the air stream approaches the air return line 22, or particles of debris located at that zone could be left behind. In accordance with the present invention, these conditions do not occur becuase the air stream flowing through the hood is progressively accelerated as it approaches the air return line 22. To accomplish these results, a simple deflector or accelerating plate 90 is mounted within the hood and extends downwardly from a position upstream of the air return line to its lowermost position at the air return line. The deflector plate 90 is bent up at 92 to join the roof panel 42 of the hood and is also secured to the side panel 54 (FIG.

3) of the air lock box. As the air stream flows along beneath the deflector 90, the cross sectional area of the duct of the pickup hood P is progressively reduced and the air stream is accelerated. This action increases the velocity of the air stream by amounts sufficient to compensate for the energy required to accelerate the debris particles. Thus, debris particles are not deposited out at the end of the duct and debris particles that are disposed on the swept surface at the end of the duct are picked up, entrained in the air stream and withdrawn through the air return line 22. Since the side walls 44, 46 (FIG. 4) of the duct are parallel, all of the restriction of the velocity increasing functions are performed by the deflector plate 90, which flattens the streams, increases its velocity and enhances the debris entrainment and pickup functions of the air stream while exerting a minimum of frictional resistance to the air flow through the duct.

In order to minimize the dropping out debris due to centrifugal force, when a portion of the air stream reaches the outer side wall 50 of the air lock (FIG. 3), a flexible curved baffle 94 is secured to the side wall 50 and makes sealing engagement with the swept surface. This baffle, which also appears in FIG. 4, minimizes dropout due to abrupt changes in direction of the air stream at the downstream corner of the pickup head. Thus, by providing the single, relatively unobstructed air duct for the air stream in a recirculating sweeper stream and by providing a simple deflector plate which flattens the stream and accelerates it before the stream leaves the duct, problems of debris dropout and of leaving debris on the swept surface are substantially eliminated.

In a typical example, the air duct dimension "d" from between the end walls 48 and 50 can be about 76 inches. The length "*l*" of the deflector plate 90 will be in the order of 18 inches. The height "*h*" of the roof 42 of the air duct above the swept surface will be about six inches and the height *h'* at the air stream exit of the deflector plate 90 will be about 4 ½ inches. These examples are given for a sweeper wherein about 3,000 c.f.m. of air are recirculated by the main blower MB and about 1,000 c.f.m. of air enters the pickup hood P under the hood flaps and under the curb brush shroud 24*a* (FIG. 1). This 1,000 c.f.m. of makeup air (which represents the air drawn through the filters by the auxiliary blower AB), joins the recirculation air leaving the air return line 22 so that in the present example about 3,000 c.f.m. of air enters the duct 40 from the line 20 from the main blower MB and about 4,000 c.f.m. of air leaves the duct 40 via the air return line 22. The above specific examples are given as the description of a preferred embodiment of the various flow rates and dimensions mentioned specifically can be modified in accordance with the dimensions and flow rates of a selected hood to give a clean sweeping action obtained by the embodiment specifically described.

Although the best mode contemplated for carrying out the present invention has been herein shown and described, it will be apparent that modification and variation may be made without departing from what is regarded to be the subject matter of the invention as defined in the appended claims.

What is claimed is:

1. In a debris pickup system for street sweepers or the like which comprises a vehicle carrying a hopper, blower means for withdrawing air from the hopper, a debris pickup hood having an air inlet line for receiving air from said blower means, and an air return line for delivering air and entrained debris from said hood to the hopper; said hood extending laterally of the vehicle and comprising an elongate box like structure extending laterally of the vehicle, said air lines being connected adjacent opposite end portions of the hood; the improvement in said hood wherein said hood has top, side and end walls, the interior of said hood cooperating with the swept surface to provide a duct-like air chamber which is substantially unobstructed along its length for chanelling the air from said blower means into a substantially unidirectional stream of air from said air inlet line to said air return line, the top wall of said duct-like chamber being inclined downwardly from a zone upstream of said air return line to the air return line to provide an air deflector for progressively accelerating said unidirectional stream of air and entrained debris as the air stream sweeps the surface and approaches said air return line.

2. The system of claim 1, wherein said duct-like chamber has parallel side walls, said air deflector gradually reducing the spacing of the top wall of the chamber from the swept surface by about 25%.

3. The system of claim 2, wherein the air return line end of said hood is formed with a baffle for smoothly deflecting the impinging air stream upwardly from the swept surface into said air return line.

4. The system of claim 3, wherein said baffle is formed to present a curved concave face to the impinging air stream.

5. The system of claim 4, wherein said baffle comprises a flexible flap for engaging the swept surface.

6. The system of claim 1, wherein said air deflector extends along about 25% of the total length of said duct-like chamber.

7. The system of claim 1, wherein said top wall of the chamber is substantially parallel to the swept surface from the air inlet line of the upstream end of said air deflector.

8. The system of claim 7, wherein the spacing of said air deflector from the swept surface of said air return line is about three-fourths of the spacing of said top wall of the chamber from said surface at the air inlet line.

9. The system of claim 8, wherein said duct-like chamber has side walls that are substantially parallel.

10. In a debris pickup system for street sweepers or the like which comprises a vehicle carrying a debris hopper, a debris pickup hood comprising a duct-like structure extending transversely of the vehicle and having surface engaging flaps, said hood having an air inlet line opening thereinto near one end, an air return line opening into said hood near the other end and connected to the hopper, and blower means for withdrawing air from the hopper and delivering air to the hood inlet line; the improvement in said hood wherein the interior of said hood cooperates with the swept surface to provide a duct-like air chamber which is substantially unobstructed along its length for channelling the air from said blower means into a substantially unidirectional stream of air from said air inlet line to said air return line, said stream of air sweeping the surface and entraining debris for delivery to the hopper via said air return line, the air return line end of said hood being formed with a baffle comprising a flexible flap for engaging the swept surface and formed to present a curved concave face to the impinging air stream, for smoothly deflecting the stream upwardly from the swept surface into said air return line, said duct-like hood chamber having an upper wall and side walls, the upper wall of said chamber comprising air deflecting means, said air deflecting means slanting downwardly from a zone upstream of said air return line to the air return line, said air deflecting means gradually accelerating the stream of air flowing toward said air return line for maintaining the entrainment of debris particles by the air stream until the air stream and entrained particles flow up into the air return line.

11. In a debris pickup system for street sweepers of the like which comprises a vehicle carrying a debris hopper, a debris pickup hood comprising a duct-like structure extending transversely of the vehicle and having surface engaging flaps, said hood having an air inlet duct opening thereinto near one end, an air outlet line opening into said hood near the other end and connected to the hopper, and blower means for withdrawing air from the hopper; the improvement in said hood wherein the interior of said hood cooperates with the swept surface to provide a duct-like air chamber which is substantially unobstructed along its length for chanelling the air from said air inlet duct into a substantially unidirectional stream of air from said air inlet duct to said air outlet line, said stream of air sweeping the surface and entraining debris for delivery to the hopper via said air outlet line, the air outlet line end of said hood being formed with a baffle formed to present a curved concave face to the impinging air stream, for smoothly deflecting the stream upwardly from the swept surface into said air outlet line, said ductlike hood chamber having an upper wall and side walls, the upper wall of said chamber comprising air deflecting means, said air deflecting means slanting downwardly from a zone upstream of said air outlet line to the air outlet line, said air deflecting means gradually accelerating the stream of air flowing toward said air outlet line for maintaining the entrainment of debris particles by the air stream until the air stream and entrained particles flow up into the air outlet line.

12. In a debris pickup system for street sweepers or the like which comprises a vehicle carrying a hopper, blower means for withdrawing air from the hopper, a debris pickup hood having an air inlet duct, and an air outlet line for delivering air and entrained debris from said hood to the hopper; said hood extending laterally of the vehicle and comprising an elongate box-like structure extending laterally of the vehicle, said air inlet duct and said air outlet line being connected adjacent opposite end portions of the hood; the improvement in said hood wherein said hood has top, side and end walls, the interior of said hood cooperating with the swept surface to provide a duct-like air chamber which is substantially unobstructed along its length for chanelling the air from said inlet duct into a substantially unidirectional stream of air from said air inlet duct to said air outlet line, the top wall of said duct-like chamber being inclined downwardly from a zone upstream of said air outlet line to the air outlet line to provide an air deflector for progressively accelerating said unidirectional stream of air and entrained debris as the air stream sweeps the surface and approaches said air outlet line.

* * * * *